United States Patent [19]

Alexander

[11] 4,442,558

[45] Apr. 17, 1984

[54] BED COVERING HAVING AN OVERALL PATTERN AND A POCKET INTEGRATED THEREIN

[76] Inventor: Carolyn Alexander, 173 Highland Pl., Monrovia, Calif. 91016

[21] Appl. No.: 214,339

[22] Filed: Dec. 8, 1980

[51] Int. Cl.[3] ..... A47G 9/02

[52] U.S. Cl. ..... 5/494; 5/482; 5/485; D6/259

[58] Field of Search ..... 5/482, 483, 484, 485, 5/486, 487, 495–502; D6/258–263

[56] References Cited

U.S. PATENT DOCUMENTS

| | | | |
|---|---|---|---|
| D. 252,308 | 7/1979 | Ochwat | D6/203 |
| D. 256,202 | 8/1980 | Schmickel et al. | 5/413 |
| 2,419,989 | 5/1947 | Day | 5/494 |
| 3,121,885 | 2/1964 | Cherry | 5/496 |
| 4.202,052 | 5/1980 | Bilanzich | 5/498 |
| 4,316,287 | 2/1982 | Rule | 5/413 |

FOREIGN PATENT DOCUMENTS

| | | | |
|---|---|---|---|
| 452756 | 11/1948 | Canada | 5/494 |

*Primary Examiner*—Alexander Grosz
*Attorney, Agent, or Firm*—Wagner & Bachand

[57] ABSTRACT

This invention involves a bed covering incorporating a pouch for a child in which the pouch is part of a fun scene on the bed cover and the child becomes part of the scene while taking a nap. The pouch is of sufficient size to allow free movement of the child and large enough to prevent a child from being trapped in the event that the child becomes twisted around in the pouch. The pouch in this invention is relatively large and is part of the design of the bed cover. The pouch of this invention exhibits localized expansion of the pattern which causes the distortion of the design to be minimized whether or not the pouch is occupied. A unique process to produce localized expansion has been developed and used in this invention.

4 Claims, 8 Drawing Figures

BED COVERING HAVING AN OVERALL PATTERN AND A POCKET INTEGRATED THEREIN

BACKGROUND OF THE INVENTION

Alternative bedding such as the sleeping bag and creative bed coverings have taken many forms. Numerous U.S. Patents for alternative bedding with a clearly defined pocket for an infant or child were issued in the late twenties and early thirties. Representative patents are:

| | | | |
|---|---|---|---|
| Young | 1,735,521 | Schmidt | 1,802,540 |
| Eaker | 1,859,820 | Smith | 1,885,558 |
| Echlin | 2,037,216 | | |

The acceptability of many of these designs were low due to the hazards associated with zippers near the portion of the bed or crib cover where a child's face and neck was to be. In addition to the unsafe position of a zipper, many of these covers provide confining, enclosed spaces with openings from which a child's head emerges from. Particularly disturbing about many of these designs is that the opening for the head of a child is designed to fit snuggly around the neck of the child. This type of bedding dangerously restrains a napping child whether it was intended to or not.

Creative bedding in the form of design blankets and design sleeping bags are very common with the blanket type represented by U.S. Pat. Nos. Des. 83,754 and Des. 160,596. The design sleeping bag seen most often specifically for use by children is represented by U.S. Pat. No. Des. 249,437. Although the existence of the design blanket and design sleeping bag is well established, the combination of the two in a safe, nonrestrictive form with an undisturbed design when occupied, has not been invented until now. A major problem with prior art pouches that are incorporated into a bed spread design is the inability to effectively integrate the pouch into any pattern. In my early attempts to produce such a bed cover or spread I encountered disruption of the pattern in the area of the pouch. The reason for the delay in development of such a bed cover was that a process to create a design that is not distorted during expansion was not in existence until now. To pleat the fabric used for a bedspread is not effective to allow expansion of the pouch and at the same time maintenance of the design on the spread. The invention of this application involves both a bed cover with a pouch for a child and the process to create a non-distorted design on the bed cover during expansion.

By employing my invention, a fun scene is created which is attractive whether occupied or not and the presence of the pouch does not detract from the scene. When the child is present in the pouch, he is visually assimilated into the scene from his own observation and that of others adding realism and providing a visually pleasant scene and an effective sleep covering for the child both physically and psychologically.

BRIEF DESCRIPTION OF THE INVENTION

Faced with the foregoing state of the art, I conceived, first, the need for an overall pattern covering at least the central area of the bed spread and a pouch opening located in an appropriate position in the pattern. Examples are, a mother Kangaroo in a scene with her pouch located at the approximate location of the opening in a bed pouch. Other examples include, a tree scene with a nest or a branch or trunk hollow suitable for a child to appear consistent with the scene, or Noah's Ark with a pouch opening following the line of the rail of the main deck, to name a few.

Next, the need exists to expand the pattern locally below the opening of the pouch whereby a degree of design continuity exists despite the bulge of the presence of a child in the pouch. The bulge may add to the realism as in the case of the rotund kangaroo or the tree trunk.

I devised a method of locally expanding the pattern in the region of the pouch by dividing the basic pattern into a number of local regions and expanding them each on a gradual basis from the bottom to the maximum at the pouch mouth and reproducing the locally expanded pattern in conjunction with the remainder of the non-expanded pattern to achieve the desired effect of integration of the pouch into the pattern.

BRIEF DESCRIPTION OF THE DRAWINGS

The foregoing brief description of my invention may be more clearly understood from the following detailed description and by reference to the drawing, in which.

DETAILED DESCRIPTION OF THE INVENTION

Figure 1:
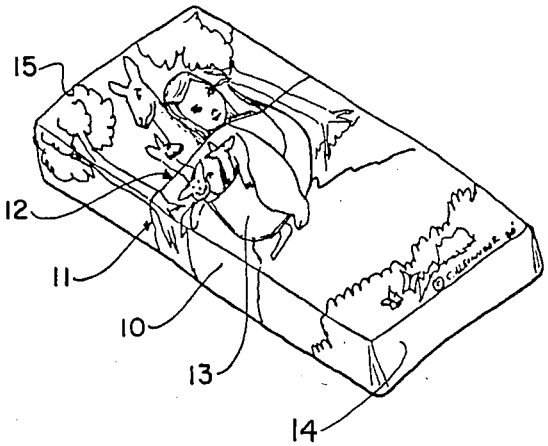
FIG. 1 is a perspective view of a child in the pouch of this invention.

One particular design integrated into a bed spread of this invention is illustrated in FIG. 1 which shows a child's bed mattress covered with a spread 10 incorporating an overall pattern which in this case is an idealized form of a kangaroo with its pups in its pouch and shown in a peaceful woods scene. The kangaroo scene, as improbable as it might seem, presents restful story-like background for the child. The kangaroo in actuality seems to fit into the background.

Hardly noticable, approximately two thirds of the distance from the foot 14 of the bed, is an apparent seam 11, but in fact is the top edge of a pouch 12 which may be of slight length e.g. 2 feet for an infant or small child or the full two thirds length for an older child.

Figure 2:
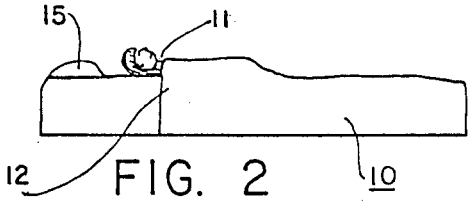
FIG. 2 is a side elevational view of the invention with the pouch occupied by a child.

The pouch 12 is located below the level of the pillows of the bed which remain undisturbed during use of the pouch by the infant or child as better illustrated in FIG. 2.

Of major significance to this invention is the fact that an overall pattern 13 is present on the spread into which the pouch 12 is integrated without disturbance of the visual effect when the pouch is empty or occupied by a child.

In FIG. 1, with an infant in the pouch 12, the spread 10 is expanded upward in the pouch 12 region and tapers to the foot 14 of the bed in the classic appearance of an occupied bed, except that the occupant's head is below level of the pillow region 15. The expansion of the pattern due to the presence of the child does not provide any significant departure from the lines of the pattern 13 above the child's head and design continuity is achieved with the child present.

Figure 3:
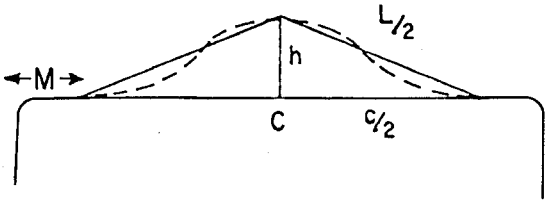
FIG. 3 is a schematic view of the geometry of expansion used in this invention.

These results are achieved by providing design expansion on a controlled basis in the production of spreads in accordance with this invention which is accomplished employing the geometric relationship shown in FIG. 3, which illustrates expansion of a length L of the pouch opening over the backing length C for a pouch height of h. The pouch in use assumes the bell shape noted by the dashed lines but for calculations, the center of the pouch may be considered as expanded to the full height h defining two triangles of height h, base length C/2 and having hypotenuses of L/2.

Using known geometric formulae, the degree of pattern expansion may be calculated as follows:

The desired child vertical clearance h is set e.g. 6" to 10"

Expansion width C is set (with an edge margin) e.g. 24–28"

For triangular expansion Length of expanded pattern is region L $$L/2=\sqrt{(C/2)^2+h^2} \quad (1)$$

Figure 4:
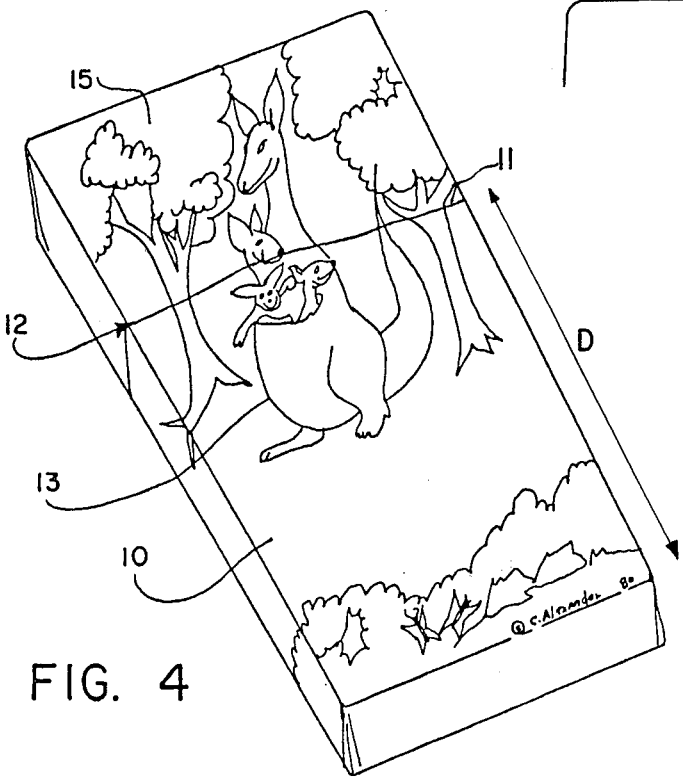
FIG. 4 is an enlarged perspective view of the invention illustrating design continuity.

In FIG. 4, the bed is shown unoccupied and it should again be noted that there appears to be design continuity despite the pouch 12, due in part to a slight bulge in the pouch region. This tends to provide a degree of depth to the pattern 13 while maintaining design continuity. The net result is a pouch spread truly integrated into the pattern.

In one particular spread I found the following dimensions to be properly proportioned:

| SIZE OF BED - SINGLE BED 39" × 79" | | | | |
|---|---|---|---|---|
| Spread overall dimensions | L | 104" | | |
| | W | 80" | | |
| Size of spread on top of bed | L | 84" | | |
| | W | 39" | | |
| Distance from top to pouch | | 34" | | |
| Pouch width (under length) | | 27" | FIG. 3 | C |
| Pouch width (over length) | | 30" | FIG. 3 | L |
| Pouch depth | | 50" | FIG. 4 | D |
| Maximum height of expanded pouch | | 6.6" | FIG. 3 | H |
| Percent expansion of pattern | | 9% | FIG. 4 | $\frac{(L-C)\%}{2(100)}$ |
| Lateral location of pouch | | 6" | from each edge FIG. 3 | M |

For a typical single bed, the expansion turns out to be approximately 5 to 20% for optimum appearance and integration of the pouch into the pattern and a sense of depth. The expansion takes place in the region of the pocket which may extend as wide as to within 6 inches of each edge of the bed without allowing the child to overhang the edge.

Figure 5:
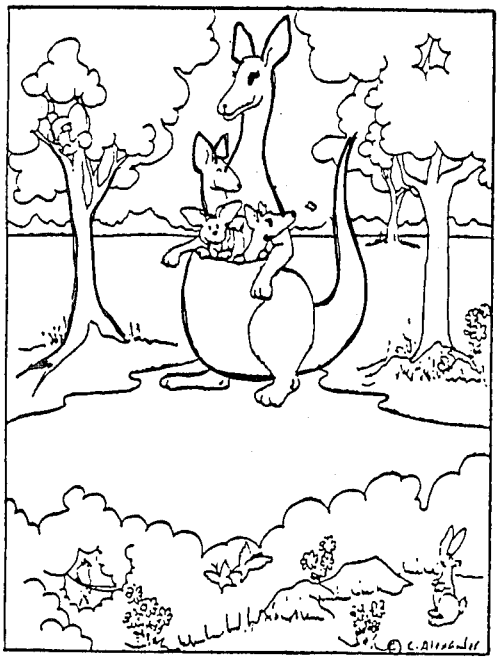
FIG. 5 is a plan view of a design for a bed cover before expansion.
Figure 8:
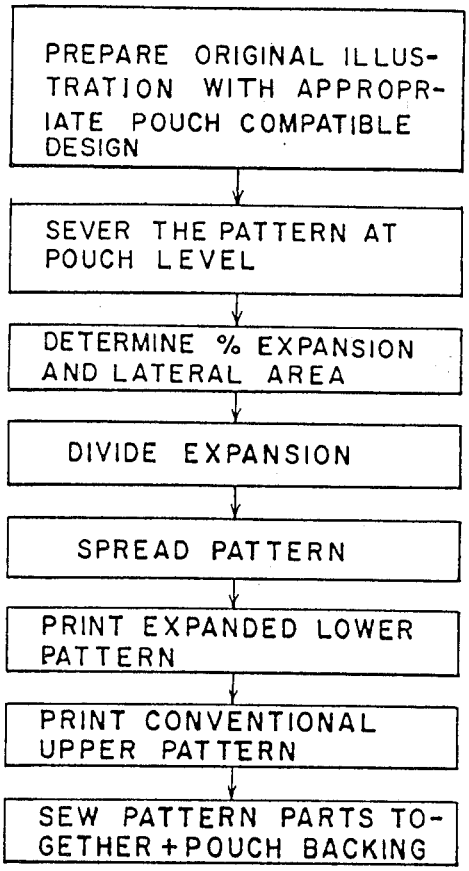
FIG. 8 is a flow diagram of the process producing a design with expansion.
Figure 6:
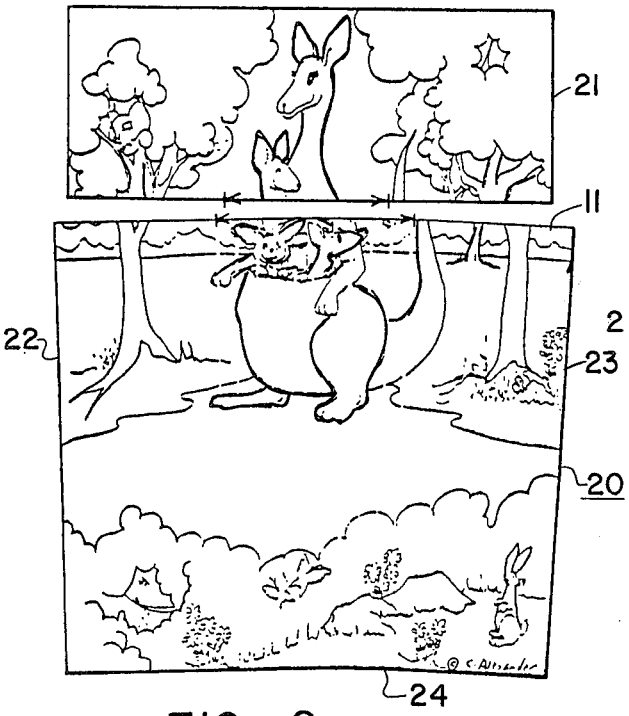
FIG. 6 is an expanded design with gaps.
Figure 7:
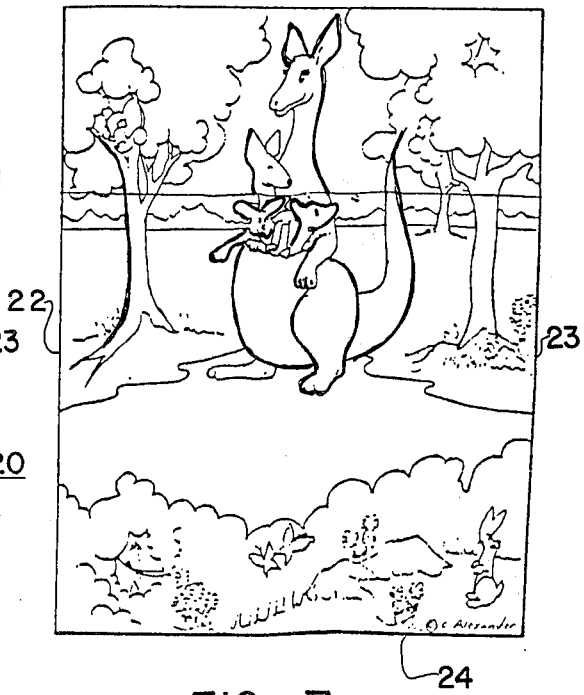
FIG. 7 is an expanded design after reconstruction to eliminate the gaps of the expansion step.

The steps of achieving a desired expansion are illustrated pictorially in FIGS. 5, 6 and 7 and in flow diagram form in FIG. 8, to which reference is now made.

The artist, in carrying out this invention, first visualizes and sketches an appropriate scene which is preferably consistent with the presence of a pouch into which the child may slip and become a part of the scene. The kangaroo scene of FIGS. 1,2 and 4 is ideal. Other scenes developed by the inventor include an elephant carrying the child in his curled trunk, Noah's ark with the child in the ark, a hollow in a tree forming a pouch with industrious squirrels abounding nearby. The application of this concept to various scenes is limited only by the artist's imagination.

After the scene is drawn to the appropriate scale, the pattern is severed at the pouch region. The correct expansion is determined and the percentage expansion is applied by a number of methods, the simplest of which is:

(a) Dividing the expansion into a number of distances either across the central region if appropriate, as in the case of a rotund kangaroo or a tree trunk or across the entire scene if appropriate;

(b) The severed and expanded lower section 20 is illustrated in FIG. 6. The slits are visible only as interruptions in the design lines in FIG. 6 but would be clearly visible in a colored pattern;

(c) Next, the design interruptions are completed and coloring restored. The lower portion 20 of the pattern is thus expanded laterally greater than the upper portion 21 as is illustrated by the greater width between the arrow heads as compared with the original length L of the top of the lower portion 20 in FIG. 6. The upper portion is printed on material of full length to provide an under side of the pouch; and (d) The expanded lower portion 20 is then printed, bound at the upper edge or lip 11 which is an apparent seam at its center region and an actual seam at each of its edges 22 and 23 and bottom edge 24 sewn to the upper portion to provide a finished spread as shown in FIG. 7 with a slight distention at the center of the pouch region giving depth thereto.

Other methods for expanding the pattern includes dividing the pattern into grid sections, producing a new grid with trapisoidal expansions of each grid square according to their location in the grid array and the percent expansion desired. Following the pattern in the standard grid, fill in each grid area producing the desired expansion when completed. Next, the printing of the expanded lower portion is accomplished as in the previously described process.

Another process for producing expanded patterns in accordance with my invention involves the printing of the pattern on a flexible resilient surface, placing an appropriately sized and shaped object under the area to be expanded, photographing the expanded patterned surface and using the photograph as the master pattern. Rubber sheeting may be used as the flexible resilient surface.

Regardless of the method used, my invention involves the controlled local expansion of a pattern in the region of the pouch of my spreads. I provide fullness in the pouch and fullness in the pattern.

Various changes may be made in carrying out this invention without departing from the concept involved. Examples are to make the upper portion 21 extend below the lip 11 only in the pouch region 12 or to extend only to the end of the mattress. In each of these cases, or others which might be envisioned, it is still possible to include the pouch with the expansion of the integrated scene on the upper surface defining the pouch. This is within my basic concept.

The above described embodiments of this invention are merely descriptive of its principles and are not to be considered limiting. The scope of this invention instead shall be determined from the scope of the following claims, including their equivalents.

What is claimed is:

1. A bed covering for use on an infant or child's bed comprising:

a body of fabric material dimensioned to cover at least the top surface of a bed;

said body having imprinted thereon a pattern depicting a scene;

a pocket in said body having an opening therein extending generally transverse to the length of the covering over a part of the width of the cover;

said pocket being expandable by outward extension of the body of fabric material upward and outward from the remaining surface of the body;

wherein said pattern in the region below the opening of the pocket is expanded and the material defining the pocket is of greater fullness than the bed covering above the pocket opening whereby the pattern appears relatively undistorted whether the pocket is occupied or not.

2. The combination in accordance with claim 1 wherein said opening is positioned with respect to the pattern whereby the additional depth afforded by the pocket constitutes a portion of the design.

3. The combination in accordance with claim 1 wherein the pattern includes a pouch and the opening in the body corresponds substantially with the opening of the pouch in the pattern.

4. The combination in accordance with claim 1 wherein said pattern is expanded substantially in accordance with the formula:

$$L/2=\sqrt{(C/2)^2+h^2}$$

where

L is the transverse expanded length of the opening h is the desired pocket height; and C is the length of the opening without expansion.

* * * * *